United States Patent [19]

Martin

[11] 4,143,829

[45] Mar. 13, 1979

[54] CORE CHUCK

[75] Inventor: John R. Martin, Rockford, Ill.

[73] Assignee: Martin Automatic, Inc., Rockford, Ill.

[21] Appl. No.: 881,581

[22] Filed: Feb. 27, 1978

[51] Int. Cl.[2] ..... B65H 17/02

[52] U.S. Cl. ..... 242/68.2; 242/72 R

[58] Field of Search ..... 242/68.2, 68.4, 72, 242/72.1, 46.4; 279/2

[56] References Cited

U.S. PATENT DOCUMENTS

| | | | |
|---|---|---|---|
| 3,018,977 | 1/1962 | Skallguist | 242/72 |
| 3,263,938 | 8/1966 | Dalglish | 242/72 |
| 3,606,187 | 9/1971 | Hahn | 242/68.2 |
| 3,910,520 | 10/1975 | Musser | 242/72 |

*Primary Examiner*—Edward J. McCarthy

*Attorney, Agent, or Firm*—Allegretti, Newitt, Witcoff & McAndrews

[57] ABSTRACT

Apparatus for releasably securing or chucking a workpiece such as a roll of web material includes a rotatable member having a slot defined therein, with a rigid member or chuck blade pivotally mounted in the slot. Rotation of the workpiece in relation to the spindle pivots the rigid member and extends it so that the workpiece is wedged across the spindle and the rigid member.

6 Claims, 6 Drawing Figures

CORE CHUCK

BACKGROUND OF THE INVENTION

This invention relates to apparatus for releasably securing, or chucking a workpiece for rotation, and more particularly, to apparatus for chucking the core of a roll of web material for rotation of the roll with a shaft.

In the past, a variety of devices have been designed for chucking a workpiece, such as a roll of web material, on a shaft or spindle. Among these devices are tapered cones that are wedged into the cores of the rolls; mechanically actuated, internally expanding jaws; and pneumatically inflatable bladders. Another such device is disclosed in U.S. Pat. No. 3,263,938 issued Aug. 2, 1966 to Herbert F. Dalglish and entitled "Core Clutch". The preferred embodiment of that device includes three elongated, cross-sectionally triangular members positioned in axially elongated cross-sectionally rectangular grooves cut into the outer surface of the spindle on which the roll is to be chucked. The triangular members are retained by a garter spring positioned in a groove cut about the circumference of the spindle, and are free to slide across the grooves and to rock up to chuck the roll, wedging themselves between the shaft and the core of the roll.

SUMMARY OF THE INVENTION

It is a principal object of the present invention to provide improved apparatus for releasably securing, or "chucking," a workpiece for rotation in at least one rotational direction.

Another object of the present invention is to provide improved apparatus for chucking the core of a roll of web material for rotation of the roll with a shaft or spindle.

Another object of the present invention is to provide improved apparatus for chucking a workpiece that is mechanically simplified in comparison with devices such as internally expanding jaws.

Another object of the present invention is to provide improved apparatus for chucking a workpiece that is "automatic" in the sense that it chucks the workpiece in response to rotation of the workpiece in relation to the spindle on which the workpiece is to be rotated, without other command or stimulus.

A further object of the present invention is to provide improved apparatus for chucking a workpiece that secures the workpiece for rotation in two opposite rotational directions.

A still further object of the present invention is to provide apparatus for chucking the core of a roll of web material for rotation of the roll with a shaft or spindle, which can be used both when the rotation of the roll rotates the spindle, and when the spindle drives the roll.

Thus, in a principal aspect, the present invention is apparatus for releasably securing a workpiece for rotation in at least one rotational direction comprising: a rotatable member having an axis of rotation and a surface with a slot defined therein; a rigid member having an end and a pivotal axis; and means for mounting the rigid member with the slot, with the pivotal axis substantially parallel to the axis of rotation, for pivotal movement about the pivotal axis between at least a first position and a second position; the end in the first position of the rigid member co-operating with the rotatable member to wedge the workpiece for rotation with the rotatable member in the one rotational direction; the end in the second position of the rigid member not co-operating with the rotatable member to wedge the workpiece; the rigid member being pivotable between the first position and the second position by rotating the workpiece in relation to the rotatable member about the axis of rotation.

That this invention satisfies the stated objects, and other objects and advantages, will become apparent from the detailed description of the preferred embodiment, which follows.

BRIEF DESCRIPTION OF THE DRAWING

The preferred embodiment of the present invention will be described with reference to the drawing, wherein.

DETAILED DESCRIPTION OF THE PREFERRED EMBODIMENT

Figure 1:
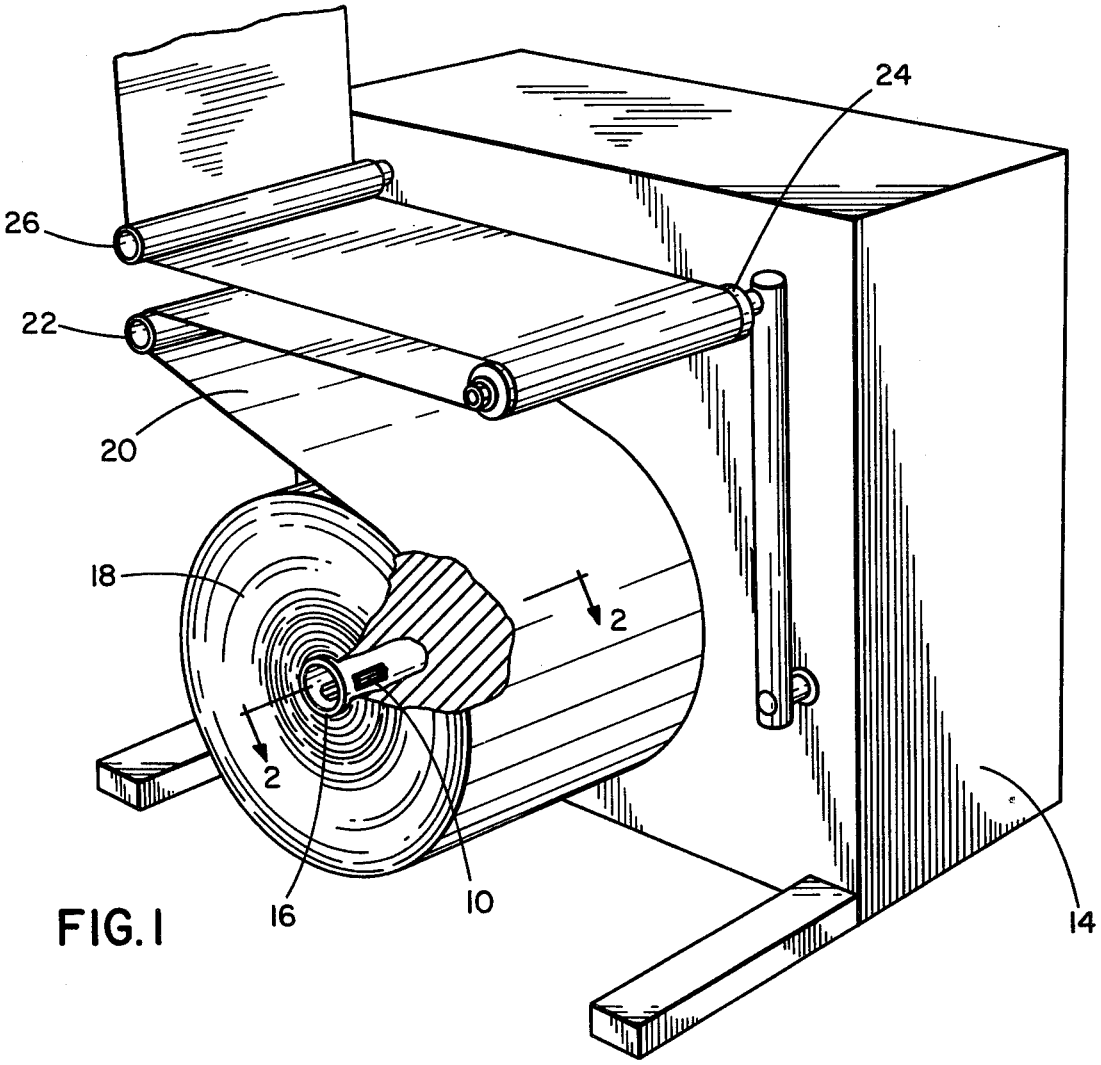
FIG. 1 is a perspective view of an unwind stand incorporating the preferred embodiment of the invention.

Referring to FIG. 1, the preferred embodiment of the present invention is shown and generally designated as apparatus 10 incorporated into an unwind stand 12.

For the purpose of illustration, the unwind stand 12 includes an upright base 14 having a cantilevered shaft or spindle 16 rotatably mounted thereon. Positioned on the spindle 16 is a roll 18 of web material 20, which is to be unrolled across the idler roller 22, across the pivotally mounted dancer 24 and the idler roller 26, and into web processing equipment (not shown). Because the web processing equipment has horizontal rollers, the spindle 16, the idler rollers 22,26 and the dancer 24 each have a horizontal axis of rotation. For other web processing equipment, other orientations of the unwind stand 12 and the apparatus 10 may be constructed.

Figure 2:
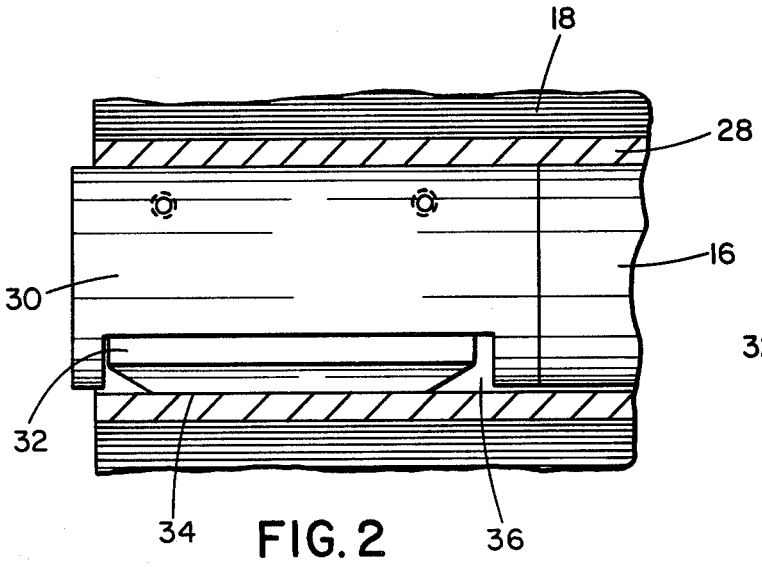
FIG. 2 is an enlarged cross-sectional view of the preferred embodiment taken along line 2—2 of FIG. 1.
Figure 3:
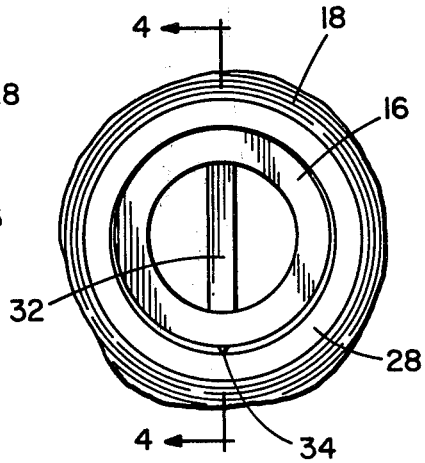
FIG. 3 is a partial, end view of the preferred embodiment.

Referring now to FIGS. 2 and 3, the roll 18 is shown in cross-section with a central, annular core 28 made of fiber, metal or similar material. The core 28 has a preselected inner diameter and the spindle 16 has an outer diameter sized substantially equal to, but less than, the inner diameter of the core 28. The roll 18 can thus be readily placed on the unwind stand 12 by sliding the roll 18 axially onto the spindle 16.

The apparatus 10, as shown in FIGS. 1-3, includes a generally annular spindle section 30 that is co-axially mounted on the outer or free end of the spindle 16. Carried within the spindle section 30 is a generally planar, generally rectangular, rigid member such as a chuck blade 32. The edge 34 of the chuck blade 32, as shown in FIG. 2, extends through a slot 36 in the spindle section 30. As will be detailed, the chuck blade 32 is mounted within the spindle section 30 for pivotal movement about a pivotal axis that is substantially parallel to the axis of rotation of the spindle section 30 and the spindle 16. As so mounted, the chuck blade 32 is pivotable from the position shown in FIGS. 2-5 to at least the position shown in FIG. 6 in which it wedges against the core 28 and chucks the roll 18 for rotation with the spindle 16.

Figure 4:
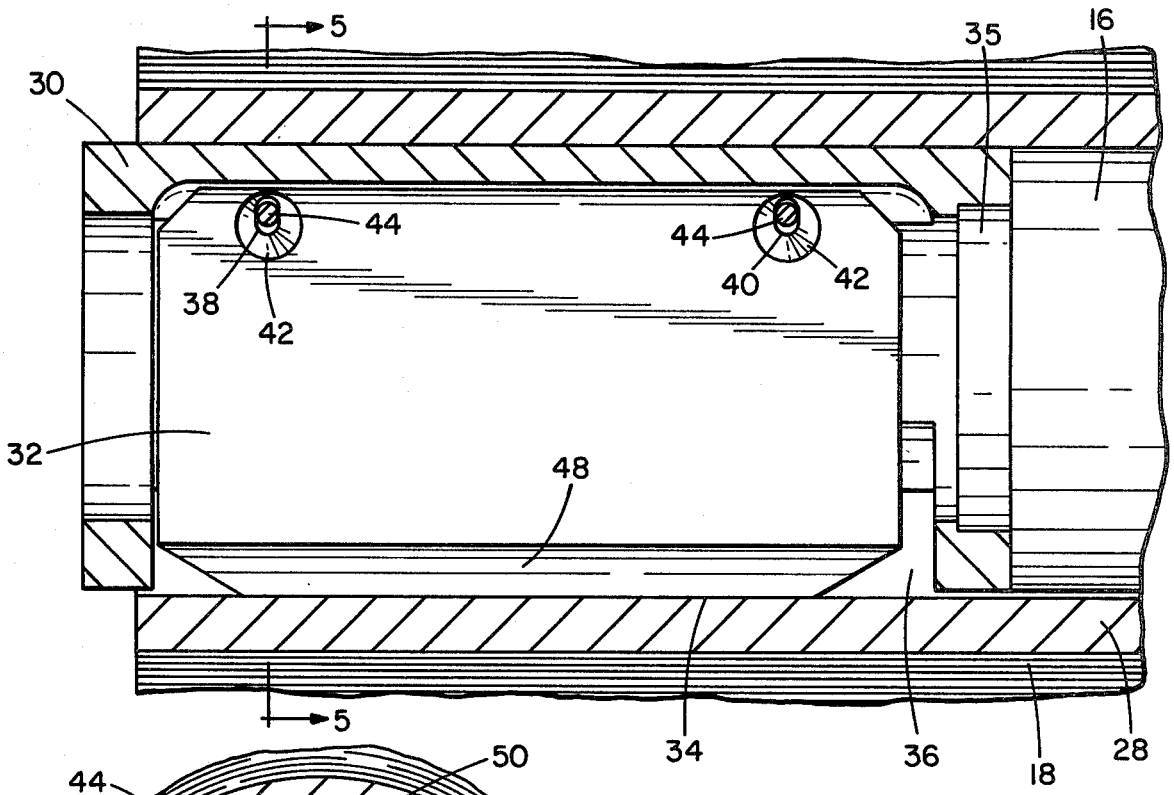
FIG. 4 is an enlarged cross-sectional view of the preferred embodiment taken along line 4—4 of FIG. 3.

Referring now to FIG. 4, the spindle 16 has a cylindrical extension 35 of reduced outer diameter integrally formed at its outer end, and the spindle section 30 has an inner diameter at its mating or right-hand end that matches the outer diameter of the extension 35. The spindle section 30 is thus adapted to be mounted on the spindle 16.

Cut through a first side of the spindle section 30 is the slot 36, which is axially elongated and cross-sectionally arcuate. The chuck blade 32 has a pre-selected axial length, and the slot 36 has an axial length substantially equal to but greater than the length of the chuck blade 32. Unrestricted pivotal movement of the chuck blade 32 in the slot 36 is thus permitted.

On the upper corners of the chuck blade 32 opposite its edge 34 are two channels 38, 40. Each of the channels 38, 40 has a rounded top and a rounded bottom, with a slight elongation in a direction perpendicular to a line running along the edge 34. On either side of the chuck blade 32, the channels 38, 40 are faced to define conical surfaces 42.

Figure 5:
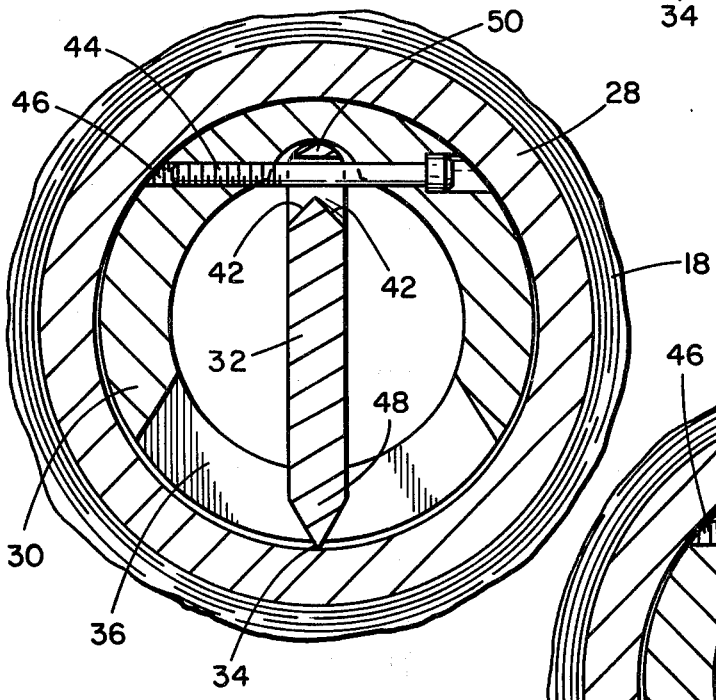
FIG. 5 is an enlarged cross-sectional end view of the preferred embodiment.

Passing through each channel 38, 40 is a fastener 44 which is screwed into a threaded hole 46 drilled transversely into the spindle section 30. As shown in FIG. 5, the holes 46 are drilled perpendicular with respect to the center line of the spindle section 30 about which the slot 36 is symmetrical. As shown in FIG. 4, the fasteners 44 are equidistant from the center of rotation of the spindle section 30, and thus an axis for pivotal movement of the chuck blade 32 is defined by the channels 38, 40 and the fasteners 44. This axis is parallel to the axis of the spindle section 30 and the edge 34 of the chuck blade 32.

Referring again to FIGS. 4 and 5, the upper corners of the chuck blade 32 are broken at an angle, and the bottom corners are inclined about 30 degrees from the line of the edge 34. In cross-section, the sides of the chuck blade 32 are tapered adjacent the edge 34 to form a blade-like end 48.

Along the edge 50, opposite the end 48 and above the channels 38, 40, the chuck blade 32 is rounded. As shown in FIG. 5, a rounded recess is defined in the side of the spindle section 30 to accomodate the rounded edge 50. This recess is diametrically opposite the slot 36 and has a radius larger than and preferably substantially equal to, that of the edge 50.

As can be seen by comparing FIGS. 4 and 5, the apparatus 10 is adapted to releasably chuck a workpiece such as a roll 18 on a spindle 16 for rotation therewith. The pivotal axis of the chuck blade 32 is offset from the cross-sectional center of the spindle section 30, and the chuck blade 32 has a dimension between the edge 34 and the channels 38, 40 equal to or greater than the radius of the spindle section 30 plus the distance by which the pivotal axis is offset. Because of this, pivoting of the chuck blade 32 in either direction from the position shown in FIG. 5 results in an extension of the edge 34 outward in relation to the spindle section 30. As the edge 34 extends, the core 28 becomes wedged across the edge 34 and the opposite side wall of the spindle section 30.

Figure 6:
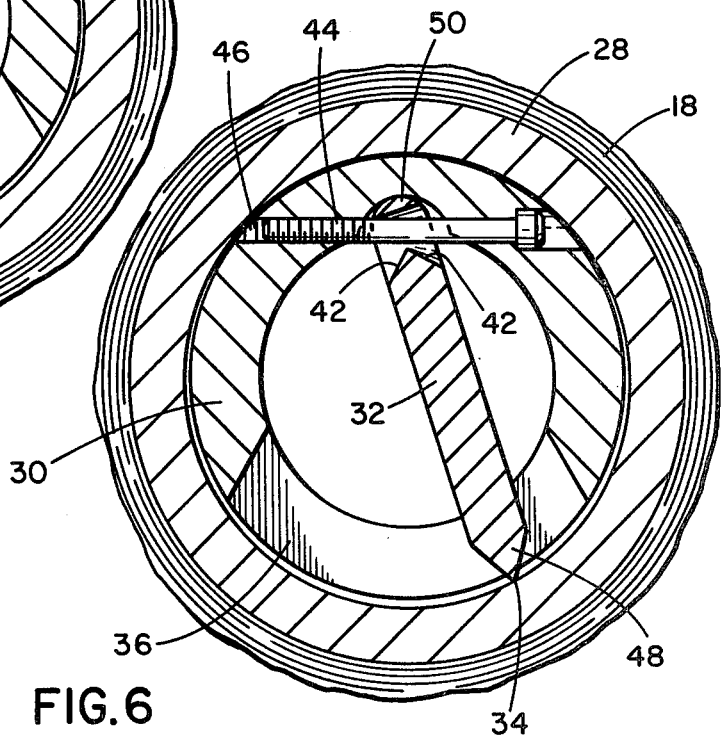
FIG. 6 is a cross-sectional view similar to FIG. 5.

The roll 18 can thus be chucked and unchucked by rotation thereof in relation to the spindle section 30. As the roll 18 is rotated the core 28 drags across the chuck blade 32 and moves it in the direction of pivotal movement of the roll 18. As preferred, the chuck blade 32 can be pivoted either left from the first position shown in FIG. 5 to a second position as shown in FIG. 6 or right to an equivalent third position.

If the roll 18 is to be used to drive the spindle, the chuck blade 32 should be pivoted in the direction of rotation. If, however, the spindle is to drive the roll 18, the chuck blade 32 should be pivoted opposite to the direction of travel. In this way, the chuck blade becomes "self-locking", in that frictional forces tend to pivot the chuck member more toward the wedging position.

The maximum pivotal movement of the chuck blade 32 is limited by the arcuity of the slot 36. The sides of the spindle section 30 adjacent the slot 36 are slanted toward the pivotal center of the chuck blade 32, as shown in FIGS. 5 and 6, to eliminate stress concentration along the chuck blade 32 when it pivots to the extreme side of the slot 36.

From the foregoing, it should be apparent to those having skill in the art that the preferred embodiment described herein could be modified or equivalent embodiments could be constructed. The preferred embodiment should thus be considered illustrative and not restrictive, and the scope of the invention should be measured by the following claims.

What is claimed is:

1. Apparatus for releasably securing a workpiece for rotation in at least one rotational direction comprising, in combination:

a rotatable member having an axis of rotation and a surface with a slot defined therein;

a rigid member having an end and a pivotal axis; and means for mounting said rigid member within said slot, with said pivotal axis substantially parallel to said axis of rotation, for pivotal movement about said pivotal axis between at least a first position and a second position;

said end in said first position of said rigid member co-operating with said rotatable member to wedge said workpiece;

said rigid member being pivotable between said first position and said second position by rotating said workpiece in relation to said rotatable member about said axis of rotation.

2. The apparatus of claim 1 wherein said rotatable member has a circular cross-section with said axis of rotation intersecting the center of said cross-section, said pivotal axis being offset from said center when said rigid member is mounted within said slot and said rigid member having a length between said end and said pivot point not less than the radius of said cross-section.

3. The apparatus of claim 2 wherein said end is aligned in the plane defined by said center and said pivotal axis when said member is in said second position.

4. The apparatus of claim 2 wherein said rigid member has a length between said end and said pivotal axis substantially equal to said radius plus the distance by which said pivotal axis is offset from said center.

5. The apparatus of claim 1 wherein said rigid member is pivotable to a third position, said end in said third position co-operating with said rotatable member to wedge said workpiece for rotation with said rotatable member in a rotational direction opposite to said one rotational direction, whereby said workpiece may be secured to said rotatable member for rotation in two rotational directions.

6. Apparatus for releasable securing a workpiece that defines a core that is circular in cross-section for rotation in two opposite rotational directions about an axis that is perpendicular to said cross-section and intersects the center thereof, said apparatus comprising, in combination:

a rotatable spindle having a spindle section thereof that is annular in cross-section, said spindle having an axis of rotation that is perpendicular to the cross-section of said spindle section and that intersects the center thereof, said spindle section having a first side wall and a second side wall diametrically opposed to said first side wall, said first side wall having an axially elongated, arcuate slot defined therein;

a rigid, elongated, and substantially rectangular chuck member having an end and a pivotal axis, said end substantially parallel to said pivotal axis; and means for mounting said chuck member to said second side wall within said spindle section, with said pivotal axis substantially parallel to said axis of rotation and offset therefrom and with said end extending through said slot, for pivotal movement about said pivotal axis between a first position, a second position and a third position;

said end in said first position of said chuck member co-operating with said second side wall to wedge said workpiece for rotation with said spindle in one rotational direction;

said end in said second position of said rigid member not co-operating with said spindle to wedge said workpiece; and said end in said third position co-operating with said second side wall to wedge said workpiece for rotation with said spindle in the rotational direction opposite said one rotational direction;

said chuck member being pivotable between said first position, said second position and said third position by rotating said workpiece in relation to said spindle about said axis of rotation.

* * * * *